US006325363B1

(12) United States Patent
Sakamoto

(10) Patent No.: US 6,325,363 B1
(45) Date of Patent: Dec. 4, 2001

(54) LOCKING MECHANISM FOR A VIBRATION ISOLATOR

(75) Inventor: Yutaka Sakamoto, Hiroshima (JP)

(73) Assignee: Delta Tooling Co., Ltd., Hiroshima (JP)

( * ) Notice: Subject to any disclaimer, the term of this patent is extended or adjusted under 35 U.S.C. 154(b) by 0 days.

(21) Appl. No.: 09/516,458

(22) Filed: Mar. 1, 2000

(30) Foreign Application Priority Data

Mar. 2, 1999 (JP) ..... 11-054020

(51) Int. Cl.[7] ..... A47C 17/00; A61G 1/06; A61G 3/00

(52) U.S. Cl. ..... 267/136; 296/19; 188/300

(58) Field of Search ..... 267/136, 64.12; 188/378–380, 300; 296/19; 248/429, 564, 421, 575, 588; 5/626, 627, 618, 424, 425, 617, 611, 210, 600, 620, 625

(56) References Cited

U.S. PATENT DOCUMENTS 3,630,565 12/1971 Lehmann et al. .

FOREIGN PATENT DOCUMENTS

1033123 * 9/2000 (EP) .
8206169 * 8/1996 (JP) .
10166806 * 6/1998 (JP) .
245774 * 9/2000 (JP) .

OTHER PUBLICATIONS

Patent Abstracts of Japan, vol. 1996, No. 10, Oct. 31, 1996 (1996–10–31) & JP 08 154781 A (Delta Kogyo Co Ltd), Jun. 18, 1966 (1996–06–18) *abstract*.

* cited by examiner

*Primary Examiner*—Douglas C. Butler
(74) *Attorney, Agent, or Firm*—Wenderoth, Lind & Ponack, L.L.P.

(57) ABSTRACT

A vibration isolator on which a stretcher is to be placed is provided with a locking mechanism for locking the vibration isolator. The locking mechanism is mounted on a movable frame of the vibration isolator, and includes a stationary portion and a movable portion mounted on the stationary portion so as to undergo a rocking motion at least in a vertical direction. The locking mechanism also includes first and second lock pins movable between a locking position and a locking release position, a link mechanism connected to the first and second lock pins, and an operation knob for operating the first and second lock pins via the link mechanism. When the operation knob is moved from the locking release position to the locking position, the link mechanism moves the first and second lock pins toward each other to sandwich a portion of the stationary portion therebetween, thereby locking the movable portion with respect to the stationary portion.

4 Claims, 7 Drawing Sheets

LOCKING MECHANISM FOR A VIBRATION ISOLATOR

BACKGROUND OF THE INVENTION

1. Field of the Invention

The present invention relates generally to a vibration isolator for use in, for example, an ambulance for carrying sick or wounded people and, in particular but not exclusively, to a locking mechanism for such a vibration isolator.

2. Description of the Related Art

A vibration isolator on which a stretcher is to be placed includes a vibration isolating mechanism employing, for example, an electrically-operated air suspension system. This system performs level adjustment according to the load (the weight of a sick or wounded person) and absorbs vibration inputted from a vehicle floor using an air spring, thereby lightening a burden applied to the sick or wounded person on the stretcher.

If the sick or wounded person must have a heart massage or the like, the vibration isolator is locked so as not to operate, thus preventing a force applied to the sick or wounded person from escaping.

Recently, a vibration isolator that employs a magneto-spring to improve the riding comfort has been proposed. The vibration isolator proposed by the applicant of this application is of a construction in which a movable frame is allowed to freely rock in the vertical direction and in the longitudinal direction of the vehicle with respect to the vehicle floor.

Accordingly, a locking device for this kind of vibration isolator is required to suppress both the vertical movement and the longitudinal movement of the movable frame. The use of conventional locking devices may give rise to incomplete locking.

SUMMARY OF THE INVENTION

The present invention has been developed to overcome the above-described disadvantages.

It is accordingly an objective of the present invention to provide a reliable locking mechanism for a vibration isolator capable of positively locking, with a simple operation, a movable frame that is allowed to rock with respect to a vehicle floor, regardless of the position of the movable frame.

In accomplishing the above and other objectives, the locking mechanism according to the present invention includes a stationary portion and a movable portion mounted on the stationary portion so as to undergo a rocking motion at least in a vertical direction. The locking mechanism also includes first and second lock pins movable between a locking position and a locking release position, a link mechanism connected to the first and second lock pins, and an operation knob movable between the locking position and the locking release position for operating the first and second lock pins via the link mechanism. When the operation knob is moved from the locking release position to the locking position, the link mechanism moves the first and second lock pins toward each other to sandwich a portion of the stationary portion therebetween, thereby locking the movable portion with respect to the stationary portion.

By this construction, it is possible to positively lock the movable frame with a simple operation.

Advantageously, the stationary portion has an opening defined therein. In this case, the first lock pin is positioned outside the stationary portion, while the second lock pin is positioned within the opening. By so doing, a portion of the stationary portion can be easily sandwiched between the first and second lock pins during locking, making it possible to achieve reliable locking, regardless of the position of the movable portion.

Furthermore, the stationary portion has a first depression formed at an outer periphery thereof and a second depression formed at a portion of the opening so as to confront the first depression. When the operation knob is at the locking position, the first and second lock pins are received in the first and second depressions, respectively. This construction can prevent not only a vertical movement of the movable frame but also a longitudinal movement of the movable frame.

Conveniently, the movable portion comprises a lock pin guide member having first and second guide grooves defined therein, in which the first and second lock pins are loosely inserted so as to move along the first and second guide grooves, respectively. By so doing, the operation of the first and second lock pins is ensured, resulting in a highly reliable lock mechanism.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein:

FIG. 2, but under the locked condition;

DETAILED DESCRIPTION OF THE PREFERRED EMBODIMENTS

This application is based on application No. 11-54020 filed Mar. 2, 1999 in Japan, the content of which is incorporated hereinto by reference.

Figure 1:
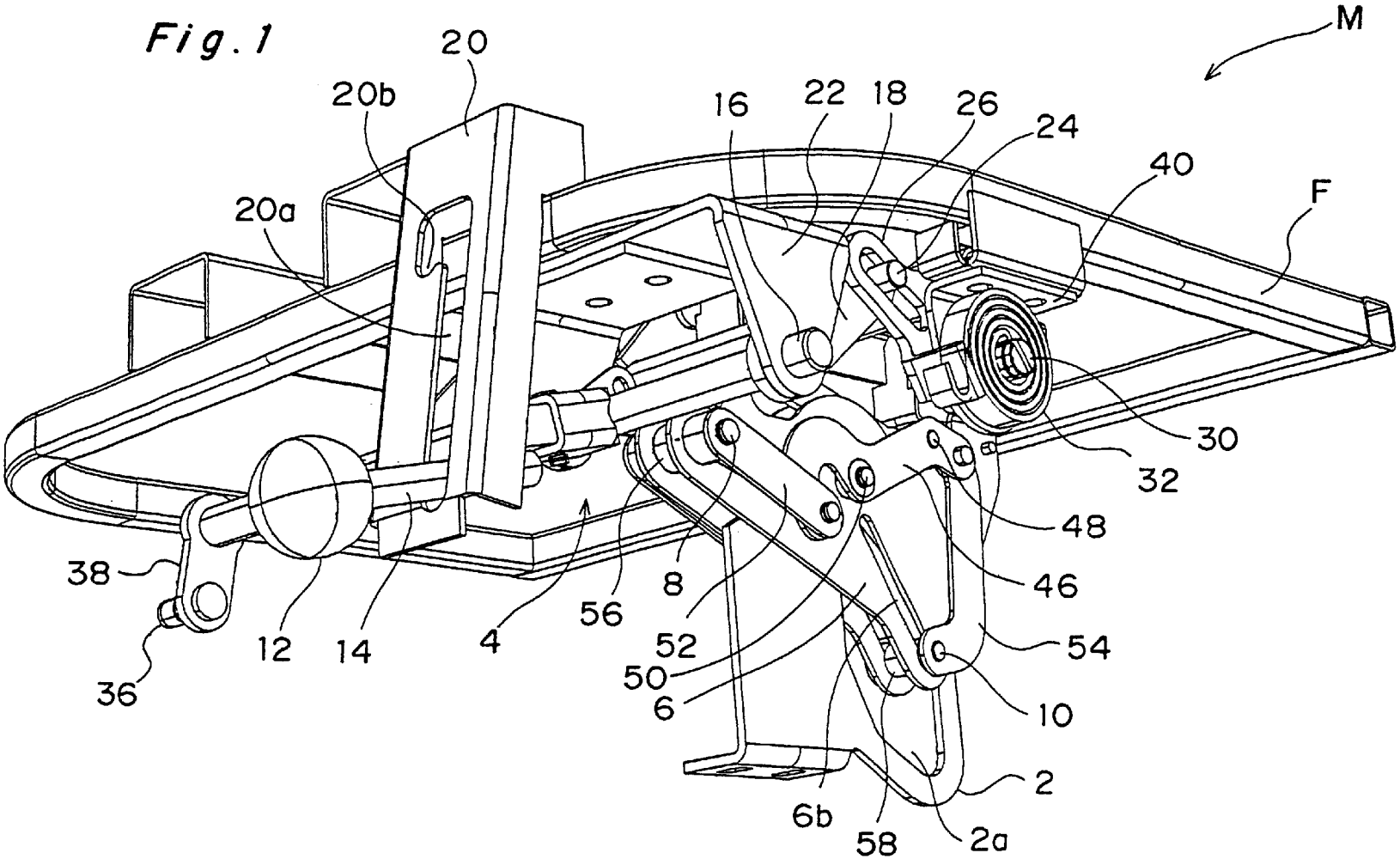
FIG. 1 is a perspective view of a locking mechanism according to the present invention that has been mounted on a movable frame of a vibration isolator.
Figure 2:
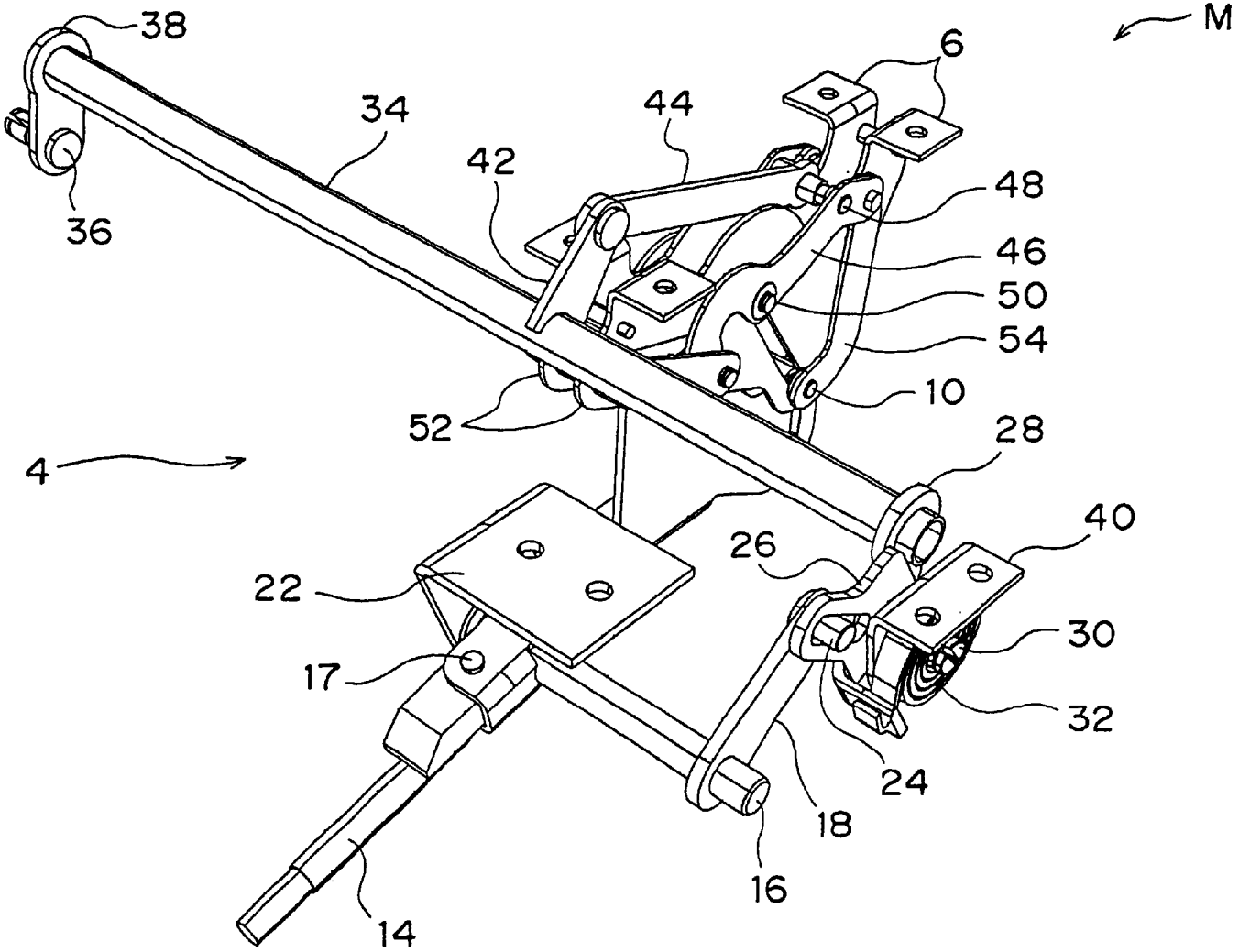
FIG. 2 is a perspective view of the locking mechanism of FIG. 1 under the locking release condition.
Figure 3:
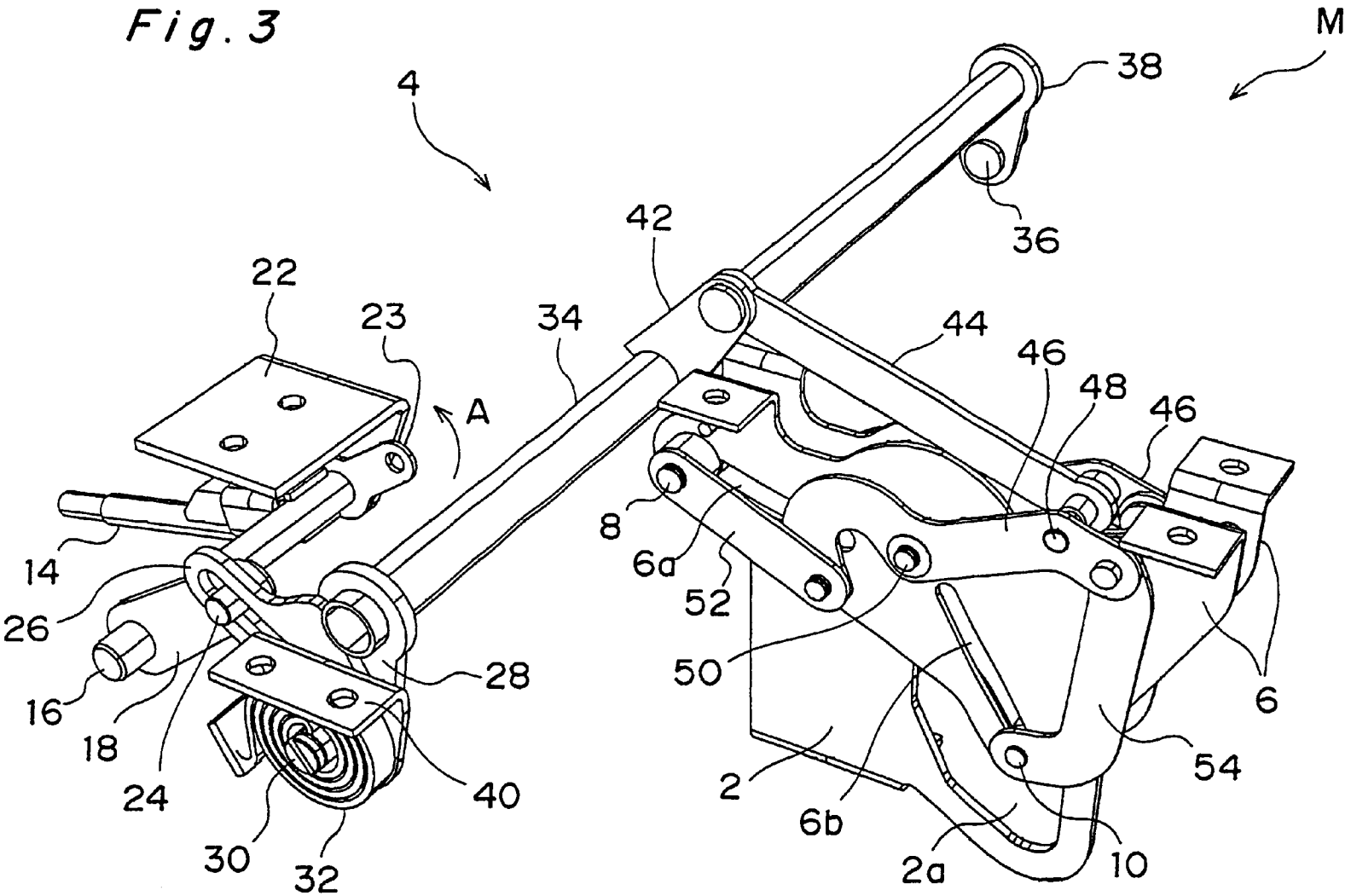
FIG. 3 is another perspective view of the locking mechanism of FIG. 1 under the locking release condition.
Figure 4:
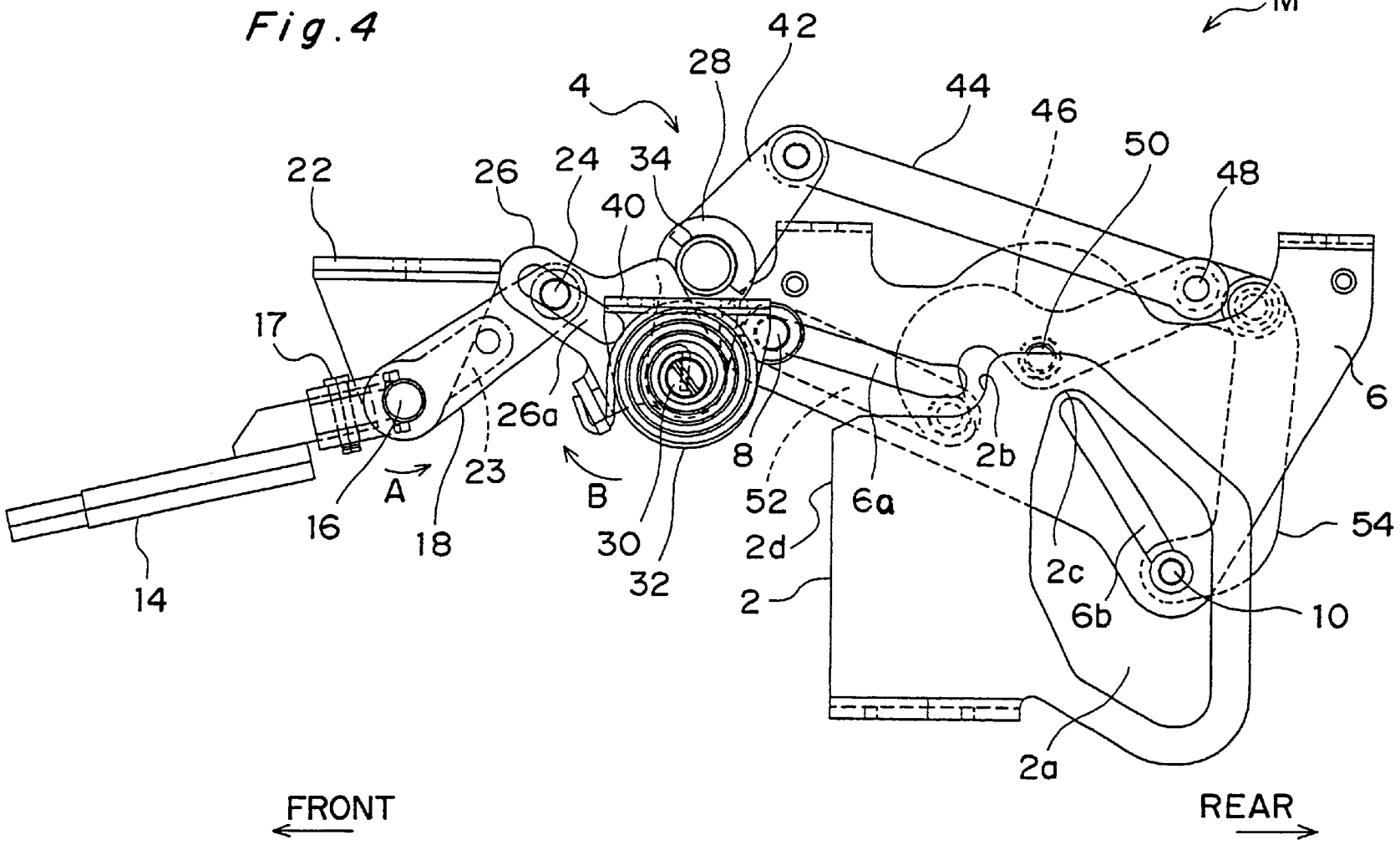
FIG. 4 is a side view of the locking mechanism of FIG. 1 under the locking release condition.
Figure 5:
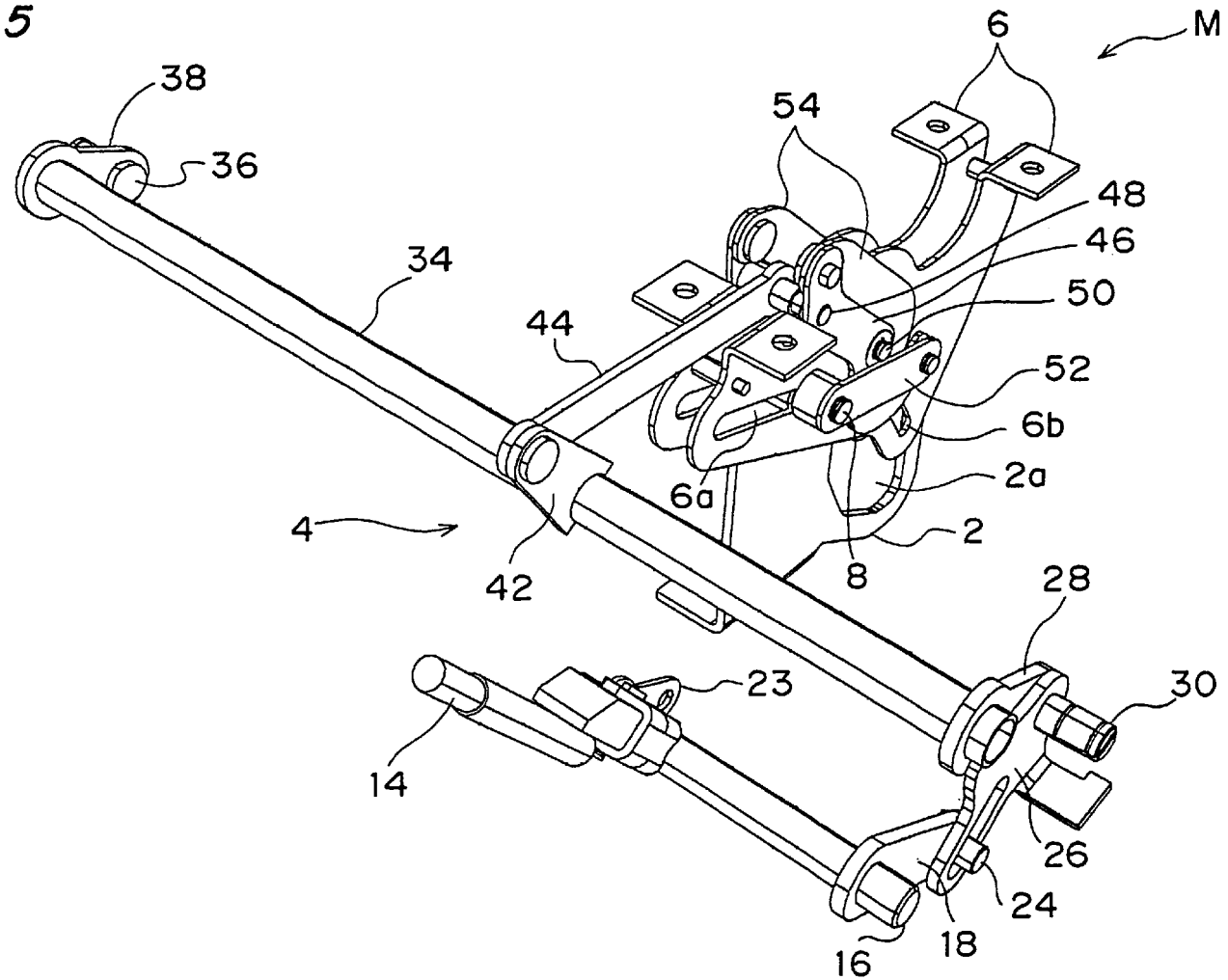
FIG. 5 is a view similar to FIG.
Figure 6:
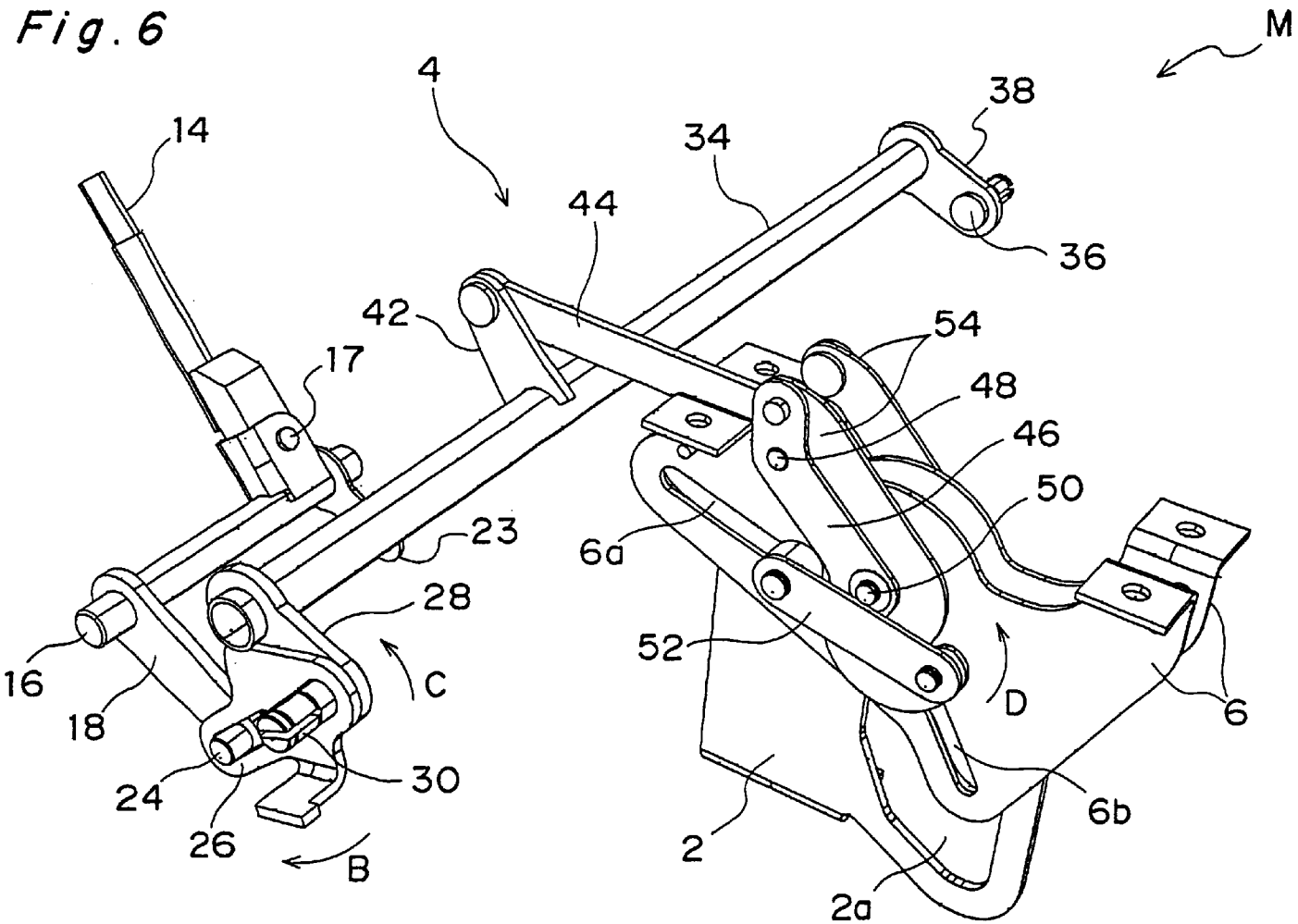
FIG. 6 is a view similar to FIG. 3, but under the locked condition.
Figure 7:
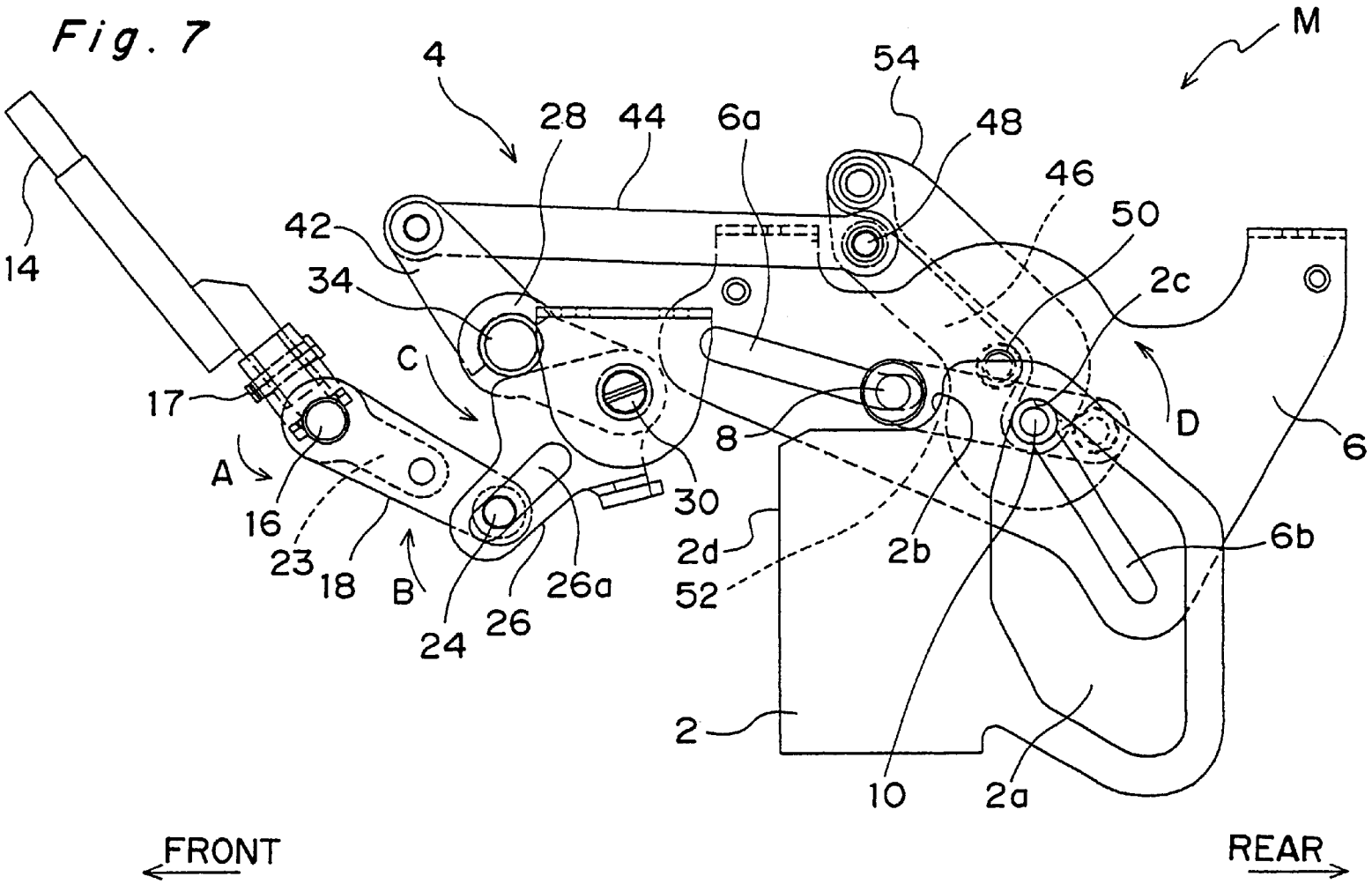
FIG. 7 is a view similar to FIG. 4, but under the locked condition.

Referring now to the drawings, there is shown in FIG. 1 a locking mechanism or device M according to the present invention for locking a vibration isolator on which a stretcher is to be placed. The locking mechanism M is mounted on a fixed portion such as, for example, a vehicle floor so as to undergo rocking motions in the vertical direction and in the longitudinal direction of the vehicle. The locking mechanism M is used to lock a movable frame F on which a sick or wounded person together with a stretcher is to be placed.

Where the vibration isolator is required to absorb vibration inputted to the sick or wounded person placed on the stretcher, the locking mechanism M is set to a free position, as shown in FIGS. 2 to 4. On the other hand, where the sick or wounded person must have a heart massage or the like, the locking mechanism M is set to a locking position to lock the movable frame F, as shown in FIGS. 5 to 7, thereby preventing a force applied to the sick or wounded person from escaping.

As shown in FIGS. 1 to 7, the locking mechanism M includes a stationary portion 2 fixed to a vehicle floor or the like and a movable portion 4 fixed to the movable frame F for rocking movement together therewith.

The stationary portion 2 includes a plate-shaped stationary frame having a movable region setting opening 2*a* defined therein for determining a movable region of the vibration isolator. The stationary frame also has a first depression 2*b* formed at an outer periphery thereof and a second depression 2*c* formed at a portion of the movable region setting opening 2*a* so as to confront the first depression 2*b*.

On the other hand, the movable portion 4 includes a pair of lock pin guide members 6, 6 fixed to the movable frame F and spaced a predetermined distance away from each other, first and second lock pins 8, 10 connected to a link mechanism, and an operation knob 12 for moving the first and second lock pins 8, 10 to respective predetermined positions via the link mechanism.

The operation knob 12 is connected to a rotary shaft 16 via an operation rod 14, which is horizontally rotatably mounted on the rotary shaft 16 via a pin 17. The operation rod 14 is vertically movably inserted in a guide groove 20*a* defined in an operation rod guide member 20, which is in turn fixedly mounted on the stationary frame F. The operation rod guide member 20 has an engaging portion 20*b* formed at an upper portion of the guide groove 20*a* to engage with the operation rod 14 when the vibration isolator is locked.

The rotary shaft 16 is rotatably connected at opposite ends thereof to a pair of generally L-shaped brackets 22, 22, which are in turn secured to the movable frame F. One end of a first lever 18 is secured to one end of the rotary shaft 16, while one end of a spring holder 23 is secured to the other end of the rotary shaft 16. One end of a coil spring (not shown) is connected to the other end (free end) of the spring holder 23, while the other end of the coil spring is connected to a portion of the movable frame F so that the rotary shaft 16 may be biased in the direction of an arrow A (the direction in which the locking is released) by means of an elastic force of the coil spring.

The first lever 18 has a pin 24 secured to the other end thereof. The pin 24 is loosely and slidably inserted in an elongated opening 26*a* defined in a drive member 26 that drives a rocking shaft (this shaft is described later). The drive member 26 is rotatably mounted on a pin 30 secured to one end of a second lever 28 and is biased in the direction of an arrow B by a spiral spring 32 connected at one end thereof to the pin 30. The second lever 28 is biased in the direction of an arrow C, i.e., in the direction counter to the direction of the arrow B.

A rocking shaft 34 is connected at one end thereof to the other end of the second lever 28 and at the other end thereof to one end of a lever 38. As is the case with the second lever 28, the lever 38 has a pin 36 secured to the other end thereof. This lever 38 is also hereinafter referred to as the second lever. The pins 30, 36 secured respectively to the second levers 28, 38 are rotatably mounted on the movable frame F via brackets 40, 40 (only one is shown) bent generally in the form of a figure "L". The rocking shaft 34 rocks about the pins 30, 36.

One end of a third lever 42 is secured to an intermediate portion of the rocking shaft 34, while the other end of the third lever 42 is rotatably connected to one end of a connecting link 44. The other end of the connecting link 44 is rotatably connected to a connecting pin 48 that connects a pair of central drive links 46, 46 disposed on respective sides of the lock pin guide members 6, 6.

The central drive links 46, 46 are rotatably mounted on a shaft 50 secured to the lock pin guide members 6, 6 at intermediate portions thereof. On each side of the lock pin guide members 6, 6, each central drive link 46 is rotatably connected at one end thereof to one end of a first lock pin drive link 52 and at the other end thereof to one end of a second lock pin drive link 54.

The first lock pin 8 is connected at opposite ends thereof to the other ends of the first lock pin drive links 52, 52, while the second lock pin 10 is connected at opposite ends thereof to the other ends of the second lock pin drive links 54, 54. The first and second lock pins 8, 10 are covered with cylindrical rollers 56, 58, respectively.

Each of the lock pin guide members 6, 6 has a first guide groove (elongated opening) 6*a* and a second guide groove (elongated opening) 6*b* both defined therein. The first and second lock pins 8, 10 are loosely inserted in the first and second guide grooves 6*a*, 6*b*, respectively.

The locking mechanism M of the above-construction operates as follows.

As shown in FIGS. 1 to 4, under the locking release (free) condition in which the vibration isolating function acts, the operation rod 14 is positioned and held at the lower end of the guide groove 20*a* formed in the operation rod guide member 20 by means of a pulling force of the coil spring engaged with the spring holder 23.

At this moment, the pin 24 of the first lever 18 is located at the uppermost position and causes the drive member 26 to push the rocking shaft 34 rearwardly. Accordingly, the connecting pin 48 of the central drive links 46, 46 connected to the rocking shaft 34 via the third lever 42 and the connecting link 44 is also pushed rearwardly. As a result, the first lock pin 8 is held at the front ends of the first guide grooves 6*a*, 6*a* of the lock pin guide members 6, 6 via the first lock pin drive links 52, 52 connected to the central drive links 46, 46, while the second lock pin 10 is held at the rear ends (lower ends) of the second guide grooves 6*b* , 6*b* of the lock pin guide members 6, 6 via the second lock pin drive links 54, 54 connected to the central drive links 46, 46.

Under such condition, because the movable portion 4 is not brought into contact with the stationary portion 2 at all, the movable frame F is allowed to freely rock, making it possible to absorb vibration inputted thereto from the vehicle floor or the like. At this moment, the movable range of the frame F is determined by the movable region setting opening 2*a* of the stationary frame 2 and is a range in which the second lock pin 10 is not in contact with the inner peripheral surface of the movable region setting opening 2*a*.

Where the sick or wounded person must have a heart massage or the like, the operation knob 12 is lifted against the biasing force of the coil spring engaged with the spring holder 23, and the operation rod 14 is then rotated about the pin 17 for engagement thereof with the engaging portion 20*b* of the operation rod guide member 20. As a result, as shown in FIGS. 5 to 7, the pin 24 is depressed to the lowermost end via the first lever 18, thus rotating the drive member 26 in the direction counter to the direction of the arrow B.

Because the second lever 28 connected to the drive member 26 is biased in the direction of the arrow C by means of the biasing force of the spiral spring 32, the second lever 28 is rotated together with the drive member 26 to move the rocking shaft 34 frontward and to incline the third lever 42 secured to the rocking shaft 34 frontward. As a result, the connecting link 44 connected to the third lever 42 is moved frontward and pulls the connecting pin 48 of the central drive links 46, 46, thereby rotating the central drive links 46, 46 about the shaft 50 in the direction of an arrow D.

When the central drive links 46, 46 are rotated in the direction of the arrow D, the first lock pin 8 is moved along the first guide grooves 6*a* , 6*a* of the lock pin guide members 6, 6 via the first lock pin drive links 52, 52 connected to the ends of the central drive links 46, 46 until the first lock pin 8 reaches the rear ends of the first guide grooves 6*a*, 6*a*, while the second lock pin 10 is moved along the second guide grooves 6*b*, 6*b* of the lock pin guide members 6, 6 via the second lock pin drive links 54, 54 connected to the other ends of the central drive links 46, 46 until the second lock pin 10 reaches the front ends (upper ends) of the second guide grooves 6*b*, 6*b*.

At this moment, because the rear ends of the first guide grooves 6*a*, 6*a* and the front ends of the second guide grooves 6*b*, 6*b* are positioned close to the first depression 2*b* and the second depression 2*c* in the stationary frame 2, respectively, the rollers 56, 58 mounted on the first and second lock pins 8, 10 are received in the first and second depressions 2*b*, 2*c*, respectively, to sandwich a portion of the stationary frame 2 therebetween. Accordingly, a rearward movement and a downward movement of the movable frame F are prevented by contact of the roller 56 with the first depression 2*b*, while a frontward movement and an upward movement of the movable frame F are prevented by contact of the roller 58 with the second depression 2*c*, thereby locking the movable frame F together with the movable portion 4 of the locking mechanism M with respect to the stationary portion 2.

The weight of the stretcher and that of the sick or wounded person are both loaded on the vibration isolator, and the position (level) of the movable frame F and that of the movable portion 4 relative to the stationary portion 2 change depending on the weight of the sick or wounded person. Accordingly, when the sick or wounded person is heavy, the level of the movable frame F is relatively low. When the movable frame F at the locking release position is locked by lifting the operation knob 12, it occurs that the roller 56 mounted on the first lock pin 8 is brought into contact with an upper portion 2*d* of the front surface of the stationary frame 2.

In this event, the drive member 26 is held at the locking position shown in FIGS. 5 to 7, while the rocking shaft 34 is held at an intermediate position between the locking release position and the locking position, as shown in FIGS. 1 to 4. Accordingly, the drive member 26 and the rocking shaft 34 are spaced away from each other.

However, because the drive member 26 and the rocking shaft 34 are biased by the spiral spring 32 in the direction in which they move towards each other, the movable frame F and the movable portion 4 are moved vertically (oscillated) relative to the stationary portion 2 during the heart massage or the like to the sick or wounded person. Once the contact of the first lock pin 8 with the upper portion 2*d* of the front surface of the stationary frame 2 is released, the rocking shaft 34 is caused to rock in the direction of the arrow C by means of the biasing force of the spiral spring 32.

As a result, the rocking shaft 34 is held in contact with the drive member 26, and the first and second lock pins 8, 10 are received in the first and second depressions 2*b*, 2*c* of the stationary frame 2, respectively, thus locking the movable frame F.

When the locking is released, the operation knob 12 is moved laterally about the pin 17 to release the engagement of the operation rod 14 with the engaging portion 20*b* of the operation rod guide member 20, the operation rod 14 is moved downward along the guide groove 20*a* by means of the biasing force of the coil spring engaged with the spring holder 23 until the operation rod 14 reaches and is held at the lower end of the guide groove 20*a*.

The movement of each member at this moment is completely the reverse of the movement referred to above from the locking release (free) condition to the locked condition and, hence, the description thereof is omitted.

It is to be noted that although in the above-described embodiment the movable frame F has been described as being allowed to rock in the vertical direction and in the longitudinal direction of the vehicle, the present invention is also applicable to a vibration isolator having a movable frame that is allowed to rock only in the vertical direction.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A locking mechanism for a vibration isolator on which a stretcher is to be placed, said locking mechanism being mountable on a movable frame of the vibration isolator and comprising:

a stationary portion;

a movable portion mounted on said stationary portion so as to undergo a rocking motion at least in a vertical direction;

a first lock pin movable between a first lock pin locking position and a first lock pin locking release position;

a second lock pin movable between a second lock pin locking position and a second lock pin locking release position;

a link mechanism connected to said first and second lock pins; and an operation knob movable between an operation knob locking position and an operation knob locking release position for operating said first and second lock pins via said link mechanism;

wherein said link mechanism is arranged such that, when said operation knob is moved from the operation knob locking release position to the operation knob locking position, said link mechanism moves said first and second lock pins toward the first and second lock pin locking positions, respectively, such that said first and second lock pins move toward each other to sandwich a portion of said stationary portion therebetween, thereby locking said movable portion with respect to said stationary portion.

2. A locking mechanism for a vibration isolator on which a stretcher is to be placed, said locking mechanism being mountable on a movable frame of the vibration isolator and comprising:

a stationary portion;

a movable portion mounted on said stationary portion so as to undergo a rocking motion at least in a vertical direction;

first and second lock pins movable between a locking position and a locking release position;

a link mechanism connected to said first and second lock pins; and an operation knob movable between the locking position and the locking release position for operating said first and second lock pins via said link mechanism;

wherein when said operation knob is moved from the locking release position to the locking position, said link mechanism moves said first and second lock pins toward each other to sandwich a portion of said stationary portion therebetween, thereby locking said movable portion with respect to said stationary portion; and wherein said stationary portion has an opening defined therein and wherein said first lock pin is positioned outside said stationary portion, while said second lock pin is positioned within said opening.

3. The locking mechanism according to claim 2, wherein said stationary portion has a first depression formed at an outer periphery thereof and a second depression formed at a portion of said opening so as to confront said first depression, and wherein when said operation knob is at the locking position, said first and second lock pins are received in said first and second depressions, respectively.

4. A locking mechanism for a vibration isolator on which a stretcher is to be placed, said locking mechanism being mountable on a movable frame of the vibration isolator and comprising:

a stationary portion;

a movable portion mounted on said stationary portion so as to undergo a rocking motion at least in a vertical direction;

first and second lock pins movable between a locking position and a locking release position;

a link mechanism connected to said first and second lock pins; and an operation knob movable between the locking position and the locking release position for operating said first and second lock pins via said link mechanism;

wherein when said operation knob is moved from the locking release position to the locking position, said link mechanism moves said first and second lock pins toward each other to sandwich a portion of said stationary portion therebetween, thereby locking said movable portion with respect to said stationary portion; and wherein said movable portion comprises a lock pin guide member having first and second guide grooves defined therein, in which said first and second lock pins are loosely inserted so as to move along said first and second guide grooves, respectively.

* * * * *